United States Patent [19]

May

[11] 4,211,144

[45] Jul. 8, 1980

[54] ADJUSTABLE PITCH DRUM

[76] Inventor: Randall L. May, 8312 Seaport Dr., Huntington Beach, Calif. 92646

[21] Appl. No.: 971,857

[22] Filed: Dec. 21, 1978

[51] Int. Cl.[2] ..... G10D 13/02

[52] U.S. Cl. ..... 84/411 A

[58] Field of Search ..... 84/411–420

[56] References Cited

U.S. PATENT DOCUMENTS

| | | | |
|---|---|---|---|
| 578,198 | 3/1897 | Boulanger | 84/411 R |
| 1,204,182 | 11/1916 | O'Conner | 84/411 A |
| 2,524,592 | 10/1950 | Cordes | 84/411 R |

FOREIGN PATENT DOCUMENTS

| | | | |
|---|---|---|---|
| 6311 | 7/1887 | United Kingdom | 84/411 A |
| 913631 | 12/1962 | United Kingdom | 84/411 R |

*Primary Examiner*—Lawrence R. Franklin

*Attorney, Agent, or Firm*—Neal J. Mosely

[57] ABSTRACT

An adjustable pitch drum consists of a drum shell having an open end and a drum head pitch changing mechanism and supporting means therefor supported on said shell. The pitch changing mechanism consists of an annular, externally threaded member supported on said drum shell; a drum head clamping hoop supported on said annular member and spaced from the end of said drum shell; and a drum head tensioning hoop supported in spaced relation to the end of said drum shell and engaging the inside of the drum head. Rotation of said drum head and the clamping hoop about said annular member moves the same longitudinally of said drum shell to vary the force exerted against the drum head by the tensioning hoop to vary the pitch of the drum. The tensions hoop is preferably supported on roller bearings supported in spaced relation to the end of the drum shell. The adjustable supporting means in the pitch changing mechanism is located external to the drum shell and thus does not interfere with the sound waves generated inside the drum shell.

1 Claim, 2 Drawing Figures

ADJUSTABLE PITCH DRUM

BACKGROUND OF THE INVENTION

1. FIELD OF THE INVENTION

This invention relates to new and useful improvements in adjustable pitch drums and more particularly to a separate independently adjustable pitch drum head having supporting means securing the same on and spaced from a drum shell.

2. BRIEF DESCRIPTION OF THE PRIOR ART

A conventional drum consists of a cylindrical drum shell having drum heads held in place by head hoops. Conventional drums are usually not tuneable except in a very narrow range by adjustment of the head hoop.

A RotoTom is a recently designed adjustable pitch drum manufactured by Remo, Inc. of North Hollywood, Calif. The RotoTom is in public use and on sale but is not described, per se, in any patent or published literature other than a limited amount of advertising literature available from the manufacturer. The RotoTom has a stand and a threaded shaft which extends upward and terminates in an end portion which abuts the head of the drum. The drum consists of a single head mounted on a supporting hoop and supported on a rigid multi-legged spider support. The spider is secured on a threaded tubular support which rides on the threaded shaft. Rotation of the supporting hoop by the drummer causes the threaded support to move upward and downward on the threaded shaft and vary the tensioning force against the drum head to tune the same.

May U.S. Pat. Nos. 4,048,895; 4,121,493 and 4,122,748 disclose adjustable pitch drums in which a RotoTom is supported on an open end of a drum shell by a supporting spider. The threaded rod which supports the RotoTom is threadedly supported in the last-named supporting spider and is adjustable to vary the position of the RotoTom drum head from the drum shell as well as permitting the independent tuning of the drum head.

The adjustable pitch drum shown and described in the aforementioned May Patents has been introduced commercially and has been well received under the name "Vari-Pitch" Drum. This adjustable pitch drum, however, has a slight disadvantage in that the adjustable supporting structure which fits within the drum shell interferes with the reflected sound waves in the drum shell and does not yield the purity of sound desired by a musician with a very sensitive ear for fine distinctions in tone and pitch. The interference of sound waves by the internal supporting structure is noted particularly when the drum is electrically amplified as disclosed in May U.S. patent application Ser. No. 927,543, filed July 24, 1978.

Accordingly, there is a need for an adjustable pitch drum in which substantially all of the adjusting structure is located external to the drum shell.

SUMMARY OF THE INVENTION

This invention comprises a new improved drum assembly consisting of an adjustable pitch drum head supported on a drum shell and supporting means therefor.

It is an object of this invention to provide a new and improved adjustable pitch drum.

Another object of this invention is to provide an improved adjustable pitch drum having a supporting structure for mounting the same on a drum shell without interfering with sound waves produced within said shell.

A feature of this invention is the provision of an independently adjustable drum head supported in spaced relation to the open end of a drum shell.

Another feature of this invention is an improved independently adjustable pitch drum having supporting means positioned substantially external to the drum shell for supporting an adjustable pitch drum head in spaced relation to the open end thereof.

Other features and objects of this invention will become apparent from time to time through the specification and claims as hereinafter related.

An adjustable pitch drum including the aforementioned features and attaining the aforementioned objects consists of a drum shell having an open end and a drum head pitch changing mechanism and supporting means therefor supported on said shell. The pitch changing mechanism consists of an annular, externally threaded member supported on said drum shell; a drum head clamping hoop supported on said annular member and spaced from the end of said drum shell; and a drum head tensioning hoop supported in spaced relation to the end of said drum shell and engaging the inside of the drum head. Rotation of said drum head and the clamping hoop about said annular member moves the same longitudinally of said drum shell to vary the force exerted against the drum head on the tensioning hoop to vary the pitch of the drum. The tensioning hoop is preferably supported on roller bearings supported in spaced relation to the end of the drum shell. The adjustable supporting means in the pitch changing mechanism is thus located external to the drum shell and does not interfere with the sound waves generated inside said shell.

DESCRIPTION OF THE PREFERRED EMBODIMENT

Figure 1:
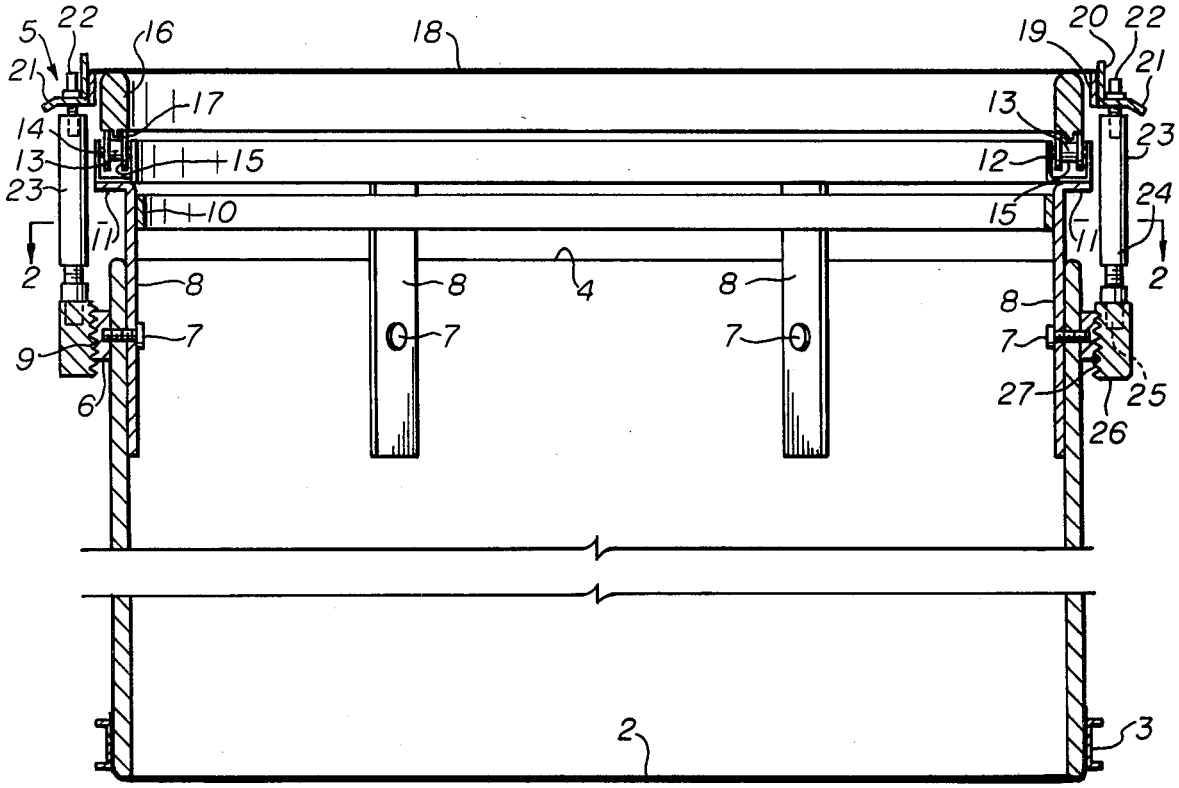
FIG. 1 is a view in longitudinal central section of an improved adjustable pitch drum representing a preferred embodiment of this invention.
Figure 2:
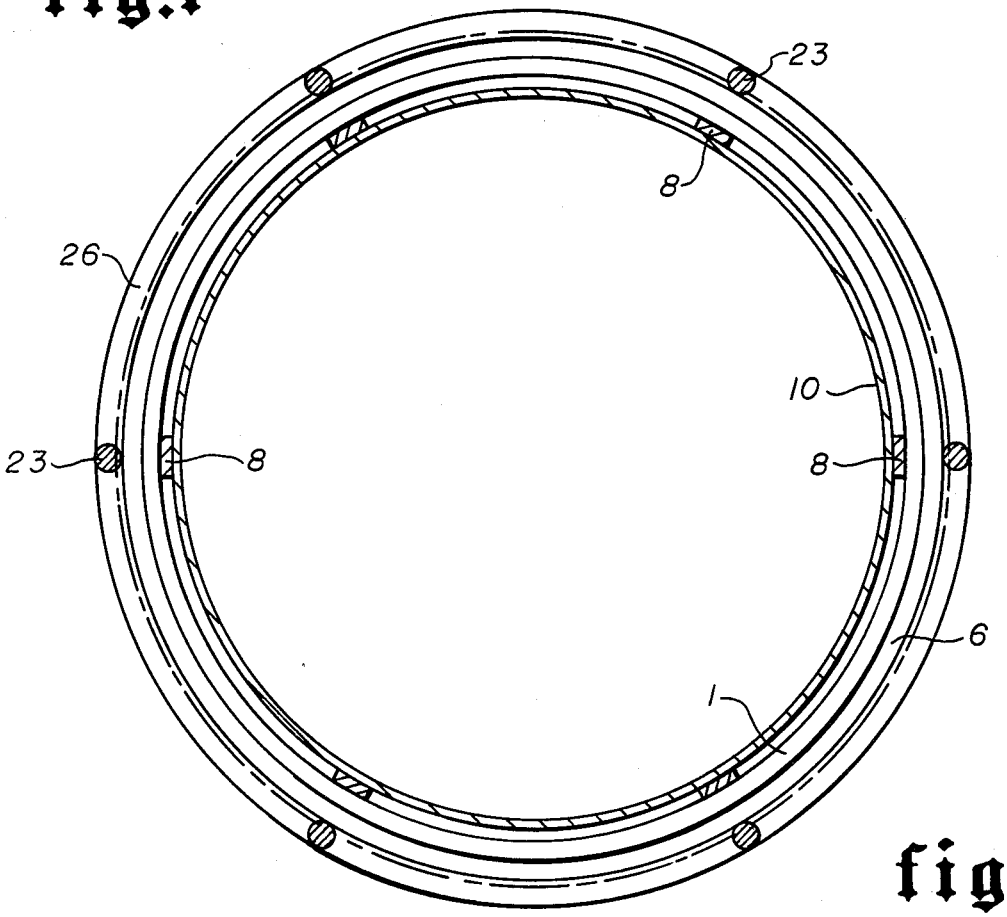
FIG. 2 is a view taken on section line 2—2 of FIG. 1.

In the drawings, there is shown an adjustable pitch drum supported on a conventional drum shell. The combination results in the advantages of adjustable pitch and tone afforded by a conventional drum shell, together with the appearance of a conventional drum. The supporting structure is located substantially on the outside of the drum shell and avoids interfering with sound waves within the shell.

In FIG. 1, the combination of an adjustable pitch drum and drum shell is shown including a conventional drum shell 1 having a lower drum head 2 held in place by a conventional drum hoop 3. The upper end of the drum is open and does not have the conventional drum head stretched thereon.

At the open end 4 of the drum shell 1 there is supported an adjustable pitch drum structure 5. Adjustable pitch drum structure 5 includes several components providing for adjustment of the drum head and a supporting structure for supporting the same on drum shell 1.

An annular ring member 6 surrounds drum shell 1 and is secured in place by a plurality of screws or bolts 7 which extends through longitudinally extending plate members 8. The external surface of annular ring member 6 is threaded as indicated at 9.

The upper ends of longitudinally extending plate members 8 are secured together by annular ring member 10 which is secured thereto by welding or brazing or the like. The upper ends of members 8 are provided with outturned flanges 11 which support a channel shaped annular member 12.

Annular member 12 is of channel shaped construction and has a plurality of roller members 13 supported for rotation therein. Roller members 13 preferably have supporting shafts 14 which extend through the walls of channel shaped member 12 and are supported for rotation therein. Roller members 13 preferably have a peripheral groove 15. A large number of roller members 13 are positioned equidistantly around channel shaped member 12.

A drum head tensioning hoop 16 is supported on rollers 13 and has an annular tongue 17 fitting into groove 15. Tensioning hoop 16 and rollers 13 are preferably formed of a plastic material having a low coefficient of friction, such as Teflon or Nylon. Tensioning hoop 16 is free to roll on rollers 13 and is supported thereby. Tensioning hoop 16 abuts the under surface of upper drum head 18 and functions to adjust the tension of drum head 18 to vary the pitch of the drum. Drum head 18 is supported at its outer periphery between supporting hoop 19 and clamping hoop 20.

Clamping hoop 20 has a peripherally extending flange portion 21 in which there are supported a plurality of clamping bolts 22 which extend into longitudinally extending rods 23. The lower end portion 24 of rods 23 are threadedly secured, as at 25 in annular adjusting ring 26. Annular adjusting ring 26 is threaded as indicated at 27 on its inner surface and mates with the threaded outer surface 9 of annular ring 6. Rotation of ring 26 about ring 6 is effective to move the same longitudinally in relation to drum shell 1.

OPERATION

The adjustable pitch drum described above is operable to vary the pitch of drum head 18 in a manner somewhat similiar to the adjustment of pitch of a RotoTom or the drum head of the prior patents of Randall L. May. A drummer may rotate the drum head by pulling on clamping ring 20 or longitudinal rods 23. This rotation causes ring 26 to rotate on ring 6. The cooperating threads 9 and 27 cause the entire drum head to be moved longitudinally in relation to drum shell 1 upon rotation. As the supporting mechanism for drum head 18 is rotated and ring 26 moves downward in relation to ring 6 drum head 18 is tightened against tensioning hoop 16. As drum head 18 is tightened against tensioning hoop 16, tensioning hoop 16 is free to rotate on rollers 13 which function as supporting roller bearings. The freedom of tensioning hoop 16 to rotate makes it possible to tighten drum head 18 against the tensioning hoop without damaging the drum head.

The drum head and drum shell assembled as described above has the appearance of a conventional drum. The rotation of the drum head, as just described, provides for variation in pitch of the drum head and allows for tuning over a wide range. As shown, the drum head is preferably supported in spaced relation to the open end 4 of drum shell 1. If desired, the supporting structure for drum head 18 may be made adjustable by providing slots in the wall of drum shell 1 through which screws or bolts 7 extend. Such slots are not shown, but would be covered by plates 8 and thus not interfere with the tone of the drum. It should be noted that this apparatus would offer the same advantages if bottom head 2 were removed.

The adjustable pitch drum construction just described has the advantage that the entire supporting structure is positioned at or exterior to drum shell 1. The supporting structure is therefore not positioned inside and across the interior of drum shell 1 and does not interfere with the reverberation of sound waves within the drum shell. This structure is particularly advantageous in an electrically amplified drum as illustrated in the aforementioned copending patent application of Randall L. May.

While this invention has been described fully and completely with emphasis upon a single preferred embodiment, it should be understood that within the scope of the appended claims the invention may be practiced otherwise than as specifically described herein.

I claim:

1. An adjustable pitch drum assembly comprising, an imperforate hollow drum shell having an open end, an exteriorly threaded annular ring member supported on the exterior of said drum shell, a second annular ring member, interiorly threaded and threadedly supported on said first named ring member, a plurality of rod members, supported in substantially parallel relation with their lower ends equally spaced and supported in said second ring member, a drum head assembly comprising a supporting hoop and a clamping hoop and a drum head secured therebetween in normally stretched relation, said clamping hoop being supported on the upper ends of said rod members in spaced relation to the open end of said drum shell, a plurality of supporting members equally spaced around the open end of said drum shell and supported on the inside of said shell and extending outwardly therefrom in parallel relation to each other and to said supporting rods, an annular member of channel-shaped cross section supported on the upper ends of said supporting members, a plurality of equally spaced roller bearing members supported in said channel shaped annular member, a tensioning hoop of a plastic material of a low coefficient of friction supported on said bearing members and abutting said drum head, and said second annular member being rotatable around said first named annular member to adjust the position of said clamping hoop and drum head relative to said tensioning hoop to vary the tension of said drum head while maintaining the same in a predetermined spaced relation to the open end of said drum shell.

* * * * *